United States Patent [19]

Hattori et al.

[11] 4,084,563

[45] Apr. 18, 1978

[54] ADDITIONAL AIR CONTROL DEVICE FOR AN INTERNAL COMBUSTION ENGINE

[75] Inventors: Tadashi Hattori, Okazaki; Hiroaki Yamaguchi, Aichi; Takamichi Nakase, Gamagori, all of Japan

[73] Assignee: Nippon Soken, Inc., Nishio, Japan

[21] Appl. No.: 740,175

[22] Filed: Nov. 9, 1976

[30] Foreign Application Priority Data

Nov. 11, 1975 Japan ..... 50-135395

[51] Int. Cl.[2] ..... F01N 3/15; F02B 75/10; F02M 37/00

[52] U.S. Cl. ..... 123/119 EC; 123/32 EE; 123/119 D; 123/124 R

[58] Field of Search ..... 123/119 EC, 119 E, 119 VC, 123/119 D, 124 R, 124 A, 124 B, 32 EE, 32 EL; 60/276, 285

[56] References Cited

U.S. PATENT DOCUMENTS

| | | | |
|---|---|---|---|
| 3,745,768 | 7/1973 | Zechnall et al. | 123/32 EE |
| 3,759,232 | 8/1973 | Wahl | 123/119 D |
| 3,815,561 | 6/1974 | Seitz | 123/32 EE |
| 3,827,237 | 8/1974 | Linder et al. | 123/32 EE |
| 3,960,118 | 6/1976 | Konomi et al. | 123/32 EE |
| 3,973,529 | 8/1976 | Wessel et al. | 123/32 EE |
| 4,019,470 | 4/1977 | Asano | 123/32 EE |
| 4,020,813 | 5/1977 | Hattori et al. | 123/124 B |
| 4,029,061 | 6/1977 | Asano | 123/32 EE |
| 4,031,866 | 6/1977 | Asano | 123/32 EE |

*Primary Examiner*—Wendell E. Burns

*Attorney, Agent, or Firm*—Cushman, Darby & Cushman

[57] ABSTRACT

An additional air control device for an internal combustion engine wherein an additional air supply to the engine is controlled by controlling the operation of a drive motor coupled to a control valve mounted in a bypass passage. The driving direction of the drive motor to open or close the control valve is controlled by a gas sensing signal representing the content of the exhaust gas and generated by a gas sensor, and the duty ratio between the drive time period $\tau a$ and the rest time period $\tau b$ of the drive motor is controlled depending on an intake air flow signal representing a delay time factor from an intake air flow meter. In deceleration operation of the engine, the duty ratio $\tau a/\tau b$ is increased independently of the intake air flow signal by a deceleration signal produced by a deceleration detecting switch. The drive motor is thus controlled to drive in a skip movement fashion and to stop alternately with the duty ratio of $\tau a/\tau b$ in an opening or closing direction of the control valve, thereby the air-fuel ratio is maintained at a constant value and the exhaust gas emission is controlled.

5 Claims, 10 Drawing Figures

ADDITIONAL AIR CONTROL DEVICE FOR AN INTERNAL COMBUSTION ENGINE

The present invention relates to additional air control devices and more particularly to an additional air control device for automobile engines which is capable of suitably compensating the air-fuel ratio of the mixture.

To obtain the maximum of efficiency of the modified internal combustion engines heretofore proposed for automotive exhaust emission control purposes or to ensure the optimum exhaust gas purifying efficiency of the catalyst mounted in engines for exhaust emission control purposes, the air-fuel ratio of the mixture supplied to the engine must always be controlled properly or the amount of secondary air supplied into the catalytic converter must be controlled properly.

In a control device of the above type heretofore proposed, for example, in U.S. Pat. No. 3,827,237 issued Aug. 6, 1974, the oxygen content of the exhaust gases, for example, is sensed by a gas sensor to detect the air-fuel ratio of the mixture and a cotrol valve is operated in response to the output signal of the gas sensor to continuously control the amount of additional correcting air to gradually decrease or increase it, thus accomplishing feedback control of the air-fuel ratio of the mixture.

In this type of control device, generally a motor is employed for operating the control valve and the time rate of change of the controlled air-fuel ratio is dependent on the rate of change of the passage area for the additional air flow which is controlled by the motor. Consequently, the control of air-fuel ratio is accomplished by presetting the motor driving speed to the optimum speed so that the control range of air-fuel ratio is minimized under the steady-state conditions as well as the transient conditions.

However, the conventional control device of this type is disadvantageous in that since the device employs an integral control system which controls the air-fuel ratio continuously and moreover the effects of other factors are not practically taken into consideration, even if the driving speed is preset to the optimum value as metnioned previously, due to the fixed driving speed, the air-fuel ratio is varied considerably under the effect of a factor, e.g., a delay time between the occurrence of a change of the air-fuel ratio in the intake system and the time that the gas sensor senses the change in the exhaust system, thus failing to ensure satisfactory control of the air-fuel ratio.

Particularly, in the light load, low rotational speed range where the amount of intake air is small, the delay time is increased causing a hunting phenomenon and thereby failing to ensure full display of the cleaning ability of the catalyst and moreover a surging phenomenon is caused during running of the vehicle and such phenomena as back fire and engine stalling are caused during the period of deceleration with the resulting deterioration of its drivability. Thus, there is much room for improvements on this type of control device.

With a view to overcoming the foregoing difficulty, it is an object of this invention to provide an additional air control device wherein the running and stopping of drive means are alternately effected intermittently through control means to satisfactorily control the amount of additional air supply under the steady-state conditions as well as the transient conditions so that as for example, the control range of the air-fuel ratio is always maintained small and thus the air-fuel ratio of mixture is maintained constant.

It is another object of this invention to provide such improved additional air control device wherein the ratio of a driving time period to a rest period of the control valve is controlled in response to a delay time factor (e.g., the amount of intake air, engine rotational speed, intake manifold vacuum, venturi vacuum, throttle position or the like) to eliminate any inconvenience due to the delay time factor and ensure satisfactory control of the additional air flow, thus ensuring full display of the ability of the catalyst and eliminating the occurrence of any surging phenomenon in the light load, low speed range of the engine to ensure an improved drivability.

It is still another object of the invention to provide such improved additional air control device wherein during deceleration of an engine, the air-fuel ratio of mixture is prevented from becoming excessively lean thus preventing the occurrence of such phenomena as back fire and engine stalling and thereby ensuring an improved drivability.

These and other objects, features and advantages of this invention will become readily apparent from the following detailed description taken in conjunction with the accompanying drawings, in which.

Figure 1:
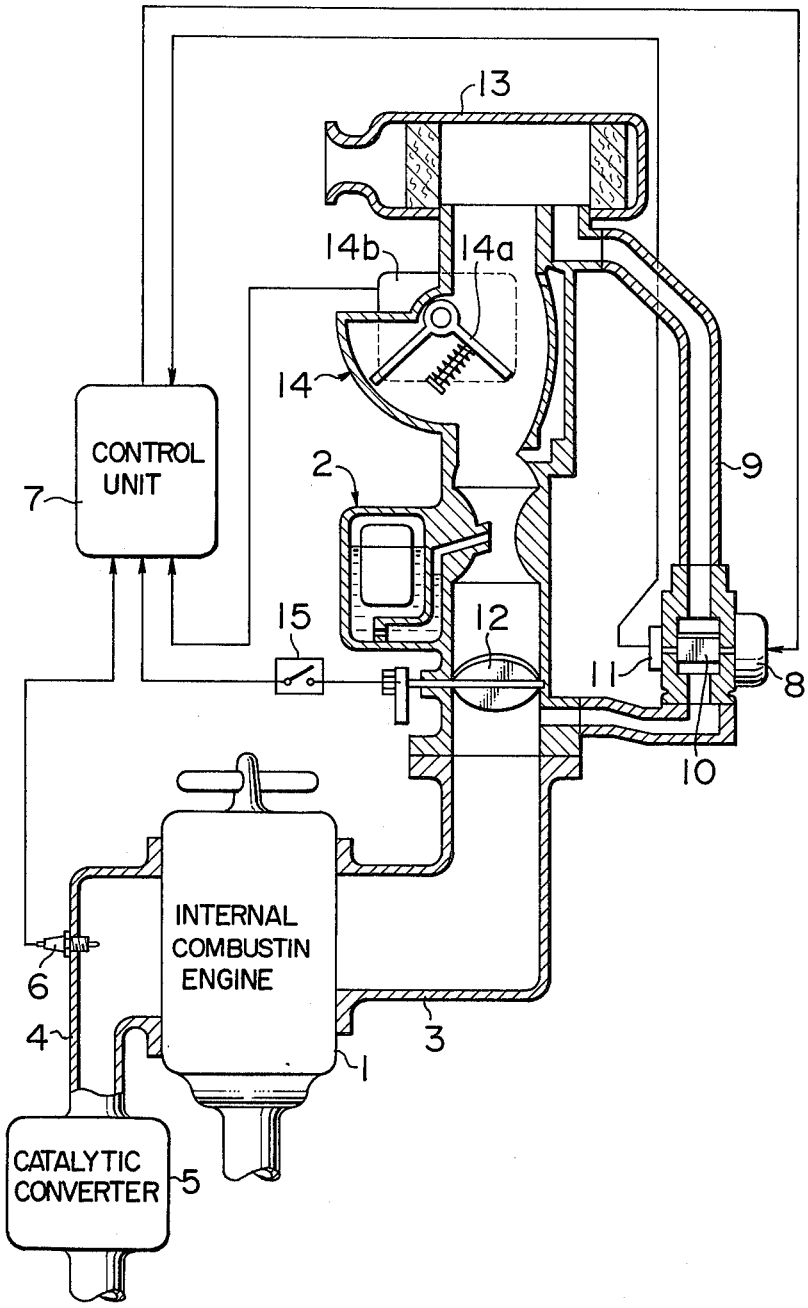
FIG. 1 is a schematic diagram showing the overall construction of an embodiment of this invention.

Referring to FIG. 1 illustrating the overall system of the invention, an internal combustion engine 1 is the conventional spark-ignition, four-cycle engine and air-fuel mixture is supplied to the engine 1 by a carburetor 2 through an intake manifold 3. The carburetor 2 having a main passage, is of the conventional type and it has been set to produce an air-fuel mixture which is slightly rich as compared with the desired air-fuel ratio demanded by the engine 1.

Figure 8:
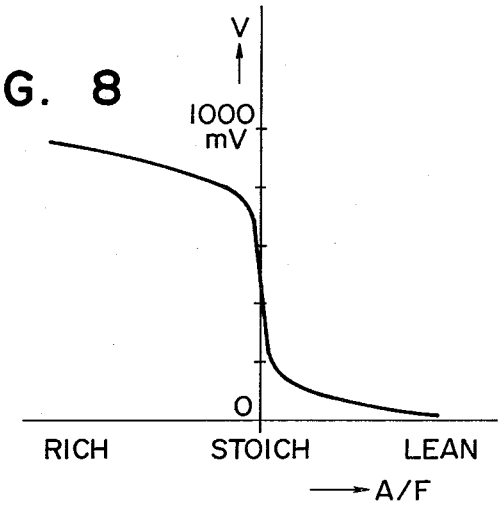
FIG. 8 is an output characteristic diagram of the gas sensor shown in FIG. 3.

Disposed in the exhaust system of the engine 1 are an exhaust manifold 4 and a three-way catalytic converter 5 and also mounted in the exhaust manifold 4 is a gas sensor 6 which detects by a metal oxide such as zirconium dioxide or titanium dioxide the content of oxygen, a constituent, of the exhaust gases. Where the gas sensor 6 employs zirconium dioxide, for example, as shown in FIG. 8, the gas sensor 6 comes into operation at around the stoichiometeric air-fuel ratio so that when the detected air-fuel ratio is rich (small) as compared with the stoichiometric one, it produces an electromotive force between 80 and 100 mV, whereas when the detected air-fuel ratio is lean (large) as compared with the stoichiometric one, the resulting electromotive force is of the order of 10 to 0 mV. An electronic control unit 7 is responsive to the signals from the gas sensor 6, etc., to drive a four-phase pulse motor 8 in a selected direction. The pulse motor 8 operates a control valve 10 mounted in an additional air passage or a bypass passage 9 to open and close and the drive shaft of the pulse motor 8 is connected to the control valve 10. The control valve 10 is a known butterfly valve and there is provided a fully closed position switch 11 so that when the control valve 10 is in its fully closed position, this is detected and a fully closed position signal is produced and applied to the control unit 7.

A throttle valve 12 is mounted in the downstream portion of the carburetor 2 and the upstream portion of the carburetor 2 includes an air cleaner 13 and an air flow meter 14 constituting delay time detecting means. The additional air passage 9 is disposed to communicate the air cleaner 13 with the downstream side of the throttle valve 12.

The air flow meter 14 directly measures the mass air flow through the intake pipe by a rotatably mounted measuring flap 14*a* and the amount of movement of the flap 14*a* is converted into an electric signal by a potentiometer 14*b* thus detecting the amount of intake air. The output terminal of the potentiometer 14*b* is electrically connected to the control unit 7.

Figure 6:
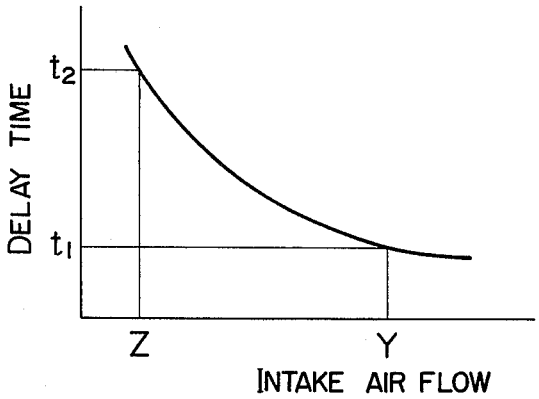
FIG. 6 is a characteristic diagram showing the relationship between the amount of intake air and the delay time.

In this case, as shown in FIG. 6, the amount of intake air flow is in a function relationship with respect to the delay time corresponding to a time period between the occurrence of a change in the air-fuel ratio and the detection in the exhaust gas system by the gas sensor, and thus the amount of intake air flow constitutes a delay time factor corresponding to the delay time.

The delay time factor detecting means may also be comprised of any sensing means for sensing the engine rotational speed, intake manifold vacuum, venturi vacuum, throttle position, or the like which is a functional element of the system delay time.

A deceleration detecing switch 15 constitutes deceleration detecing means for detecting deceleration of the engine 1 and in view of the fact that in this embodiment the throttle valve 12 is fully closed during periods of deceleration, the switch 15 consists of a switch whose contacts are closed upon detection that the throttle valve 12 has been fully closed.

This deceleration detecting means may also be comprised of a known type of magneto or potentiometer coupled to the shaft of the throttle valve 12 so as to detect deceleration of the engine 1 in response to the movement of the throttle valve 12.

Figure 2:
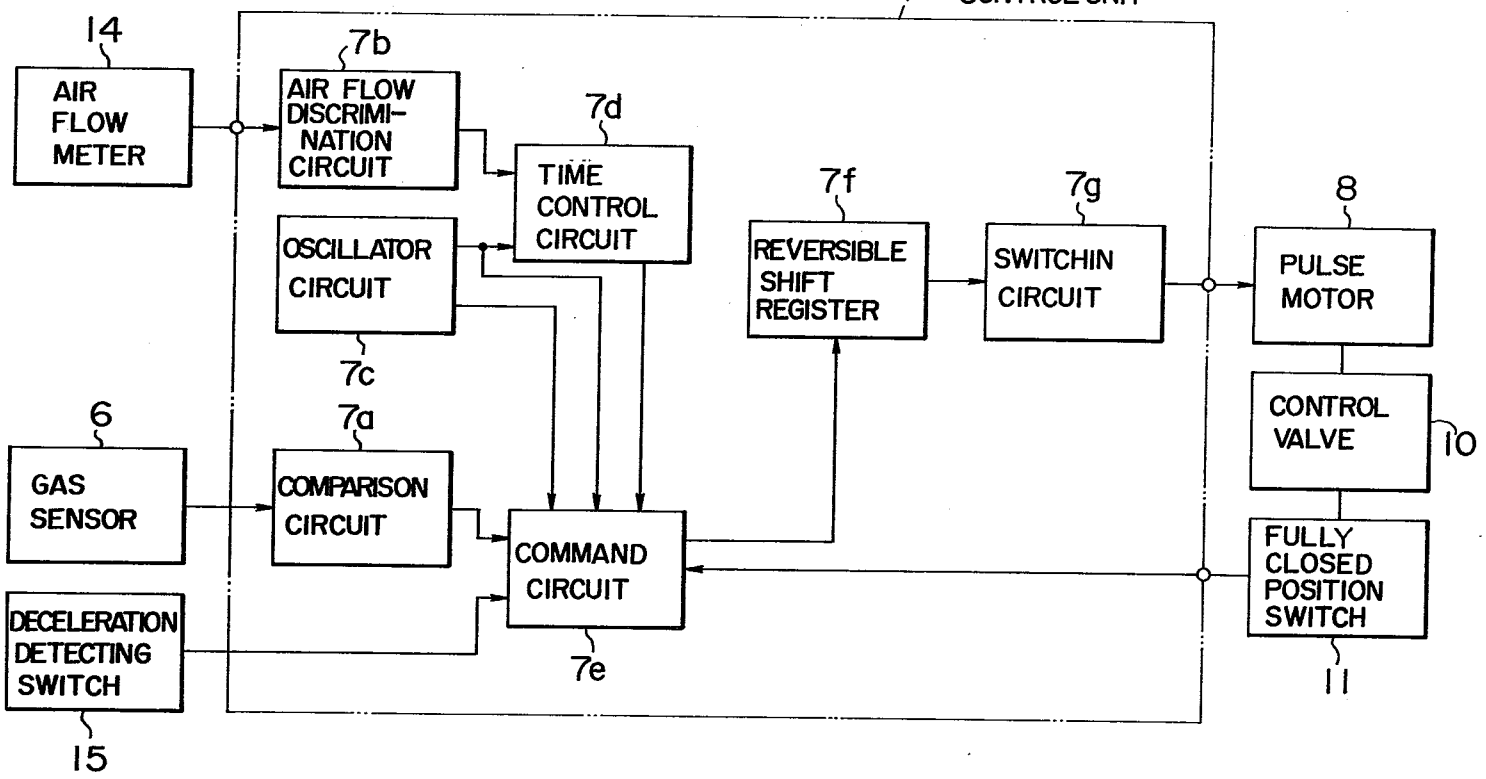
FIG. 2 is a block diagram of the electronic control unit shown in FIG. 1.
Figure 3:
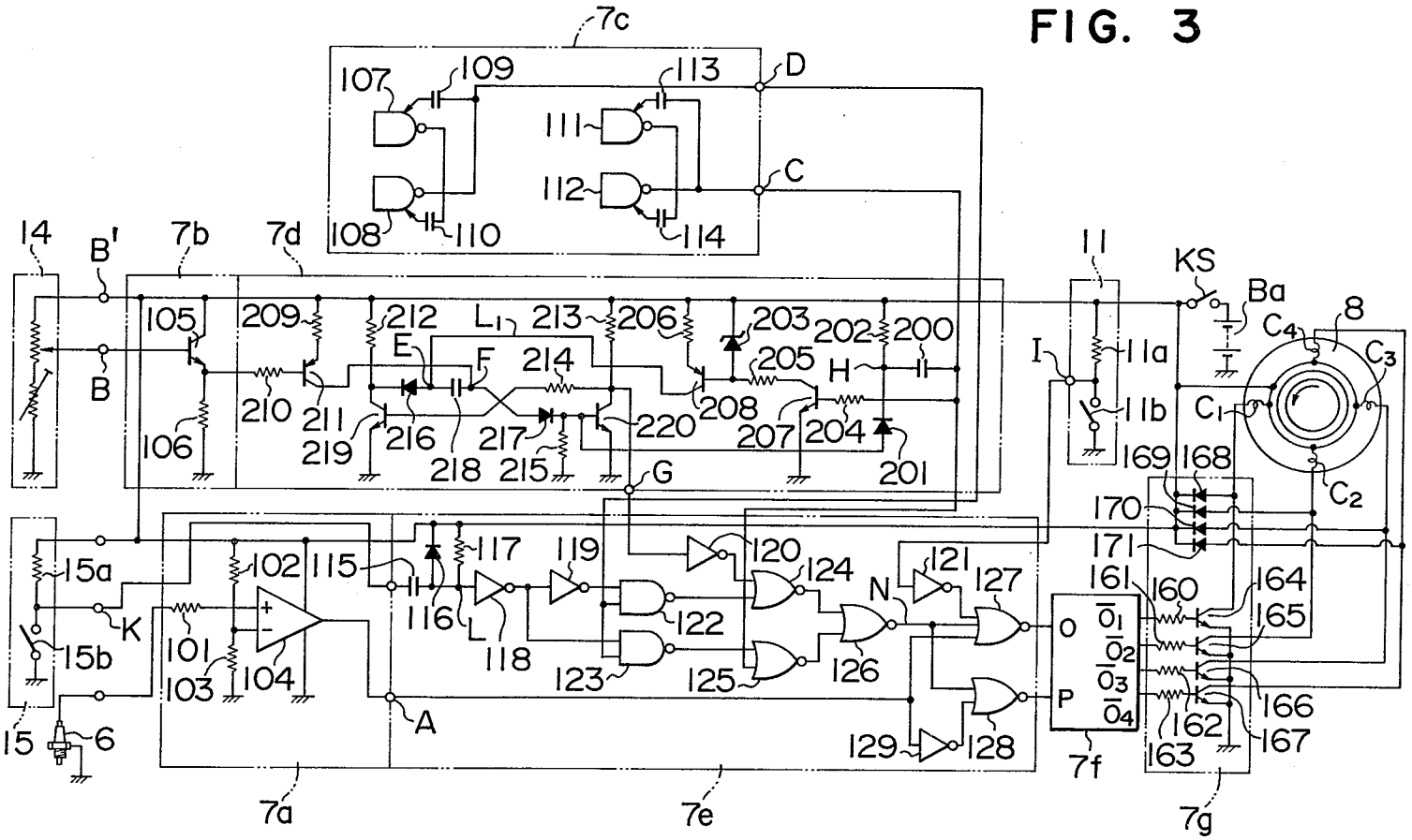
FIG. 3 is a wiring diagram of the electronic control unit shown in FIG. 1.

Next, the electronic control unit 7 will be described with reference to the block diagram of FIG. 2. The control unit 7 receives as its input signals the gas sensing signal of the gas sensor 6 which is produced in accordance with the oxygen content of exhaust gases, the signal from the air flow meter 14 for detecting the amount of intake air which is one of the delay time factor, the signal from the deceleration detecting switch 15 and the signal from the fully closed position switch 11, and the control unit 7 comprises a comparison circuit 7*a*, an air flow discrimination circuit 7*b*, an oscillator circuit 7*c*, a time control circuit 7*d*, a command circuit 7*e*, a reversible shift register 7*f* and a switching circuit 7*g*, thereby operating the pulse motor 8 in accordance with the input signals.

With this construction, basically the air-fuel mixture produced in the carburetor 2 is burned in the combustion chambers of the engine 1 and thereafter any change in the air-fuel ratio is detected in the exhaust system by the gas sensor 6 whose output signal is in turn applied to the comparison circuit 7*a* where the air-fuel ratio is determined whether it is rich or lean as compared with the preset air-fuel ratio to be controlled (the stoichiometric air-fuel ratio in this embodiment), so that when the air-fuel ratio is rich, the pulse motor 8 operates the control valve 10 mounted in the additional air passage 9 in a direction which opens it, whereas when the air-fuel ratio is lean the control valve 10 is operated in a direction which closes it, thus compensating the air-fuel ratio to attain the preset air-fuel ratio by means of the additional air supplied to the downstream side of the throttle valve 12.

In this case, under acceleration as well as constant speed conditions, the operation of the pulse motor 8 is effected by the time control circuit 7*d* through the command circuit 7*e*, the reversible shift register 7*f* and the switching circuit 7*g* only for a certain time period within a predetermined period which is determined in accordance with the signal from the air flow meter 14 or the system delay time between the time of supplying additional air into the intake system of the engine 1 and the occurrence of a change in the composition of the exhaust gases in the exhaust system, namely, the running and stopping of the pulse motor 8 are alternately effected intermittently, whereas during the period of deceleration discriminated by the signal from the deceleration detecting switch 15 the pulse motor 8 is operated intermittently with a relatively long running time irrespective of the signal from the air flow meter 14.

Thus, by properly controlling the direction and time of operation of the pulse motor 8 so as to operate the control valve 10, the flow of additional air is properly controlled and the air-fuel ratio of mixture is compensated by the additional air supplied to the downstream side of the throttle valve 12 to always attain a preset air-fuel ratio with a small control range.

The control unit 7 will now be described in greater detail with reference to FIGS. 3 to 7. The comparison circuit 7*a* comprises an input resistor 101, voltage dividing resistors 102 and 103, and a differential operational amplifier (OP AMP) 104, and the OP AMP 104 has its noninverting input terminal connected to the gas sensor 6 through the input resistor 101 and its inverting terminal to the voltage dividing point of the dividing resistors 102 and 103. Thus, the comparison circuit 7*a* compares its input voltage with a preset voltage preset by the voltage dividing resistors 102 and 103 (i.e., the voltage practically equal to the electromotive force produced by the gas sensor 6 at the stoichiometric air-fuel ratio), so that a "1" level signal is produced at its output terminal A when the input voltage is higher than the preset voltage or richer than the stoichiometeric one, whereas a "0" level signal is produced at the output terminal A when it is lower than the preset voltage or leaner than the stoichiometric one.

The air flow discrimination circuit 7*b* comprises an emitter-follower circuit including a transistor 105 and an emitter resistor 106 and the base of the transistor 105 is connected to a variable terminal B of the potentiometer 14*b* of the air flow meter 14. Thus, the potential difference between the variable terminal B and a fixed terminal B' which is inversely proportional to the amount of intake air, is detected and applied to the time control circuit 7*d*.

The oscillator circuit 7*c* comprises a first oscillator including NAND gates 107 and 108 with expander terminals and capacitors 109 and 110 constituting an astable multivibrator and a second oscillator including NAND gates 111 and 112 and capacitors 113 and 114 constituting an astable multivibrator.

Figure 4A:
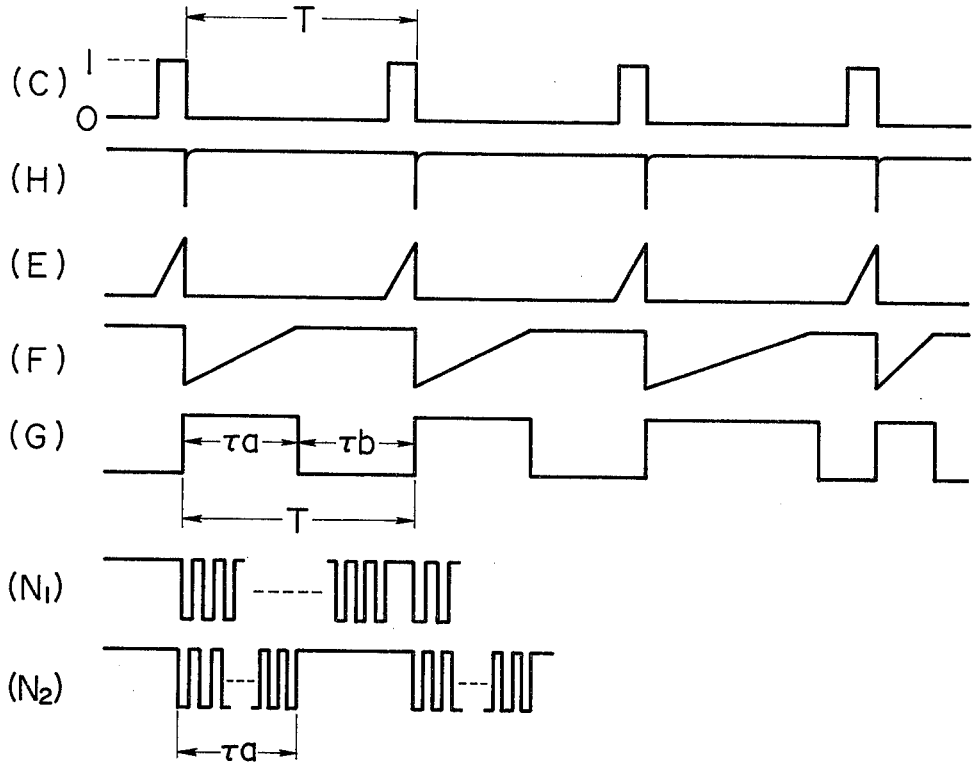
FIGS. 4A and 4B are waveform diagrams useful in explaining the operation of the electronic control unit.
Figure 4B:
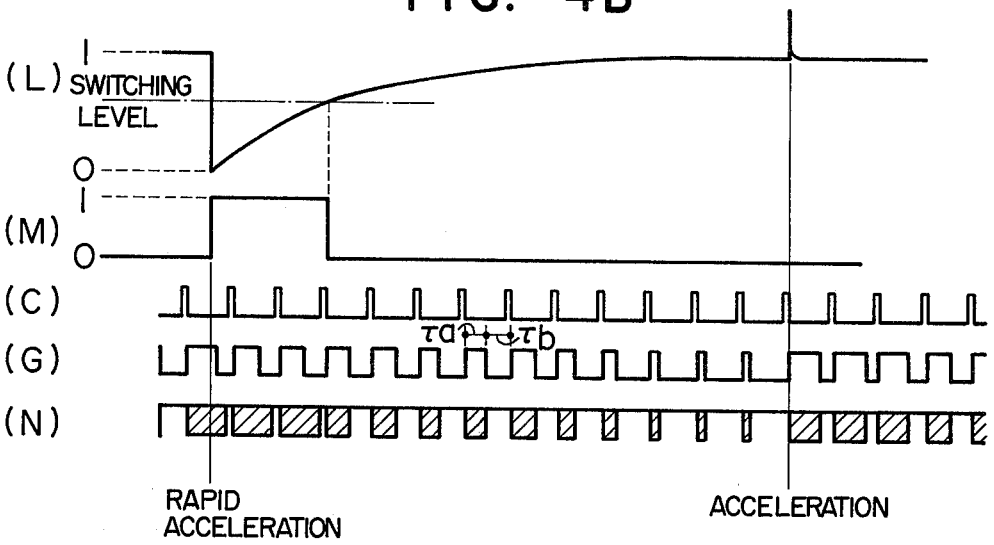
Figure 5A:
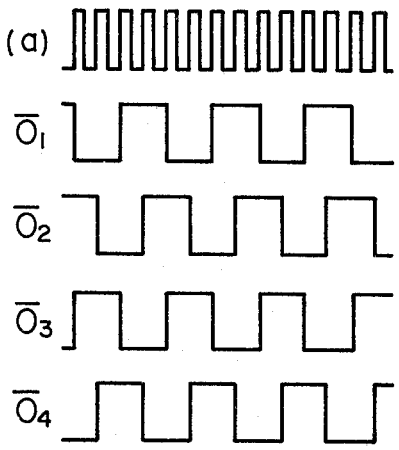
FIGS. 5A and 5B are waveform diagrams useful in explaining the operation of the reversible shift register shown in FIG. 3.
Figure 5B:
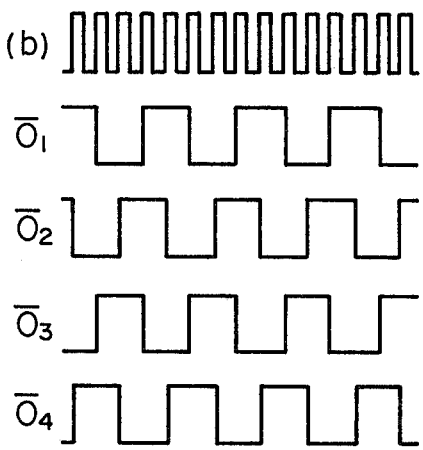

The first oscillator produces pulses for driving the pulse motor 8 and its output waveform at its output terminal D consists of rectangular pulses having a duty ratio of 1 : 1 as shown in (a) and (b) of FIGS. 5A and 5B, respectively. The frequency of the rectangular pulses is set to such a value which is suitable to skip drive the pulse motor 8. The second oscilaltor produces pulses for controlling the running time or drive time of the pulse motor 8 and its output waveform at its outputs terminal C has a large duty ratio as shown in (c) of FIG. 4 with its period T being preset longer than that of the pulses produced from the first oscillator.

The time control circuit *7d* comprises a trigger circuit including a capacitor 200, a diode 201 and a resistor 202, a charging circuit including resistors 204, 205 and 206, a Zener diode 203 and transistors 207 and 208, a discharging circuit including resistors 209 and 210 and a transistor 211, and a monostable circuit incluidng resistors 212, 213, 214 and 215, diodes 216 and 217, a capacitor 218 and transistors 219 and 220 and it produces a rectangular pulse having a pulse width $\tau a$ corresponding to the amount of intake air as shwon by the waveform (G) in (a) of FIG. 4.

When the output at the output terminal C of the second oscillator goes to the "1" level, the transistors 207 and 208 of the charging circuit are turned on and a constant current determined by the Zener diode 203 flows to the monostable circuit through a conductor $L_1$. In the monostable circuit, the capacitor 218 is charged with the constant current and the charge potential at its terminal E increases as shown by the waveform (E) in (a) of FIG. 4. During this time interval, a current determined by the potentiometer 14*b* of the air flow meter 14 and inversely proportional to the amount of intake air is supplied to the monostable circuit from the discharging circuit and the transistor 220 is turned on through the didoe 217. Then, when the output rectangular pulse of the second oscillator shown in by the waveform (C) in (a) of FIG. 4 goes to the "0" level, the transistors 207 and 208 are turned off so that a negative trigger signal is produced at a terminal H of the trigger generating circuit by the waveform (H) as shown in (a) of FIG. 4 on completion of the charge of the capacitor 218 and the transistor 220 is turned off through the diode 201. Thus, the output derived from the collector of the transistor 220 and produced at the output terminal G of the time control circuit *7d* goes from the "0" to "1" level.

On the other hand, in response to the turning off of the transistor 220 the transistor 219 is turned on and the potential across the capacitor 218 drops rapidly. When this occurs, the charge stored in the capacitor 218 during the charge is discharged and dissipated by a discharge current corresponding to the amount of intake air and thereafter the discharge potential at a terminal F of the capacitor 218 rises as shown in (F) of FIG. 4 and the transistor 220 is again turned on.

In this way, during the time that the transistor 220 remains off, the output of the time control circuit *7d* remains at the "1" level thus producing a drive pulse signal having a pulse width $\tau a$ as shown by the waveform (G) in (a) of FIG. 4 and this drive pulse width $\tau a$ is proportional to the amount of intake air as mentioned previously.

The fully closed position switch 11 comprises a resistor 11*a* and a switch 11*b* so that when the control valve 10 is brought into the fully closed position, the switch 11*b* is closed and the output at its output terminal I goes to the "0" level. Thus, when the control valve 10 has been in its fully closed position, the drive motor is prohibited to drive the control valve to a further closing direction.

The deceleration detecting switch 15 which is similar in construction with the fully closed position switch 11, comprises a resistor 15*a* and a switch 15*b* and it is operatively connected to the throttle valve 12. Thus, when the throttle valve 12 is fully closed, the switch 15*b* is turned on and the output at its output terminal K goes to the "0" level.

The output signals of the comparison circuit *7a*, the oscillator circuit *7c*, the time control circuit *7d*, the fully closed position switch 11 and the deceleration detecting switch 15 are applied to the command circuit *7e* which in turn produces the required forward, reverse and stop signals for the pulse motor 8.

The command circuit *7e* comprises inverters 118, 119, 120, 121 and 129, NAND gates 122 and 123, NOR gates 124, 125, 126, 127 and 128, a capacitor 115, a diode 116 and a resistor 117 and it constitutes a control logic for the pulse motor 8.

In this circuit, the capacitor 115, the diode 116 and the resitor 117 constitute an input section for receiving the signal from the deceleration detecting switch 15 or a type of delay circuit which holds the signal from the deceleration detecting switch 15 for a predetermined time. In other words, when its switch 15*b* is turned on, the voltage level at an output terminal L rapidly goes from the "1" to "0" level as shown by the waveform (L) in (b) of FIG. 4 and thereafter the voltage level starts rising again according to a charging curve determined by the time constant dependent on the capacitor 115 and the resistor 117.

When this voltage level is below the switching level of the inverter 118, the output of the inverter 118 remains at the "1" level as shown by the waveform (M) in (b) of FIG. 4, whereas when the voltage level becomes higher than the switching level of the inverter 118 the output of the inverter 118 goes from the "1" to "0" level.

Thus, according to the present embodiment, the output of the inverter 118 remains at the "1" level for a predetermined time after the turning on of the deceleration detecting switch 15 and this time interval is detected as the deceleration period of the engine 1.

Consequently, during the period of deceleration, the output of the inverter 118 remains at the "1" level with the result that the output of the NAND gate 122 goes to the "1" level and simultaneously the output of the NOR gate 124 goes to the "0" level. In other words, irrespective of the output of the time control circuit *7d* whose pulse width varies in accordance with the signal from the air flow meter 14, the output of the NOR gate 124 goes to the "0" level and it is applied to the NOR gate 126.

On the other hand, during this deceleration period, the pulse motor driving pulse signals produced from the first oscillator and inverted as shown in FIGS. 5A and 5B, respectively, appear at the output of the NAND gate 123 and the pulse signals are applied to the NOR gate 125. The NOR gate 125 also receives the pulse signal produced from the second oscillator and having a fixed duty ratio as shown by the waveform (C) in (a) of FIG. 4, so that the NOR gate 125 produces at its output the pulse motor driving pulse signals from the first oscillator only when the pulse signal from the second oscillator is at the "0" level and the driving pulse signals are applied to the NOR gate 126. As a result, the NOR gate 126 produces, at its output, pulse signals having a waveform as shown by the waveform ($N_1$) in (a) of FIG. 4 or the inverted output signals of the NOR gate 125 and the pulse signals are applied to the NOR gates 127 and 128, respectively. The NOR gate 127 has three input terminals for receiving the signals produced from the fully closed position switch 11 and the comparison circuit *7a* in addition to the pulse signals from the NOR gate 126, whereas the NOR gate 128 has two input terminals for receiving the signal from the comparison circuit *7a* through the inverter 129 in addition to the pulse signals from the NOR gate 126.

Thus, only when the control valve 10 is not fully closed and the air-fuel ratio of mixture is large (lean), the inverted output pulse signals or the pulse signals from the NOR gate 126 are delivered from the NOR gate 127 as its output and the pulse signals are applied to an input terminal 0 of the reversible shift register *7f*.

On the contrary, only when the air-fuel ratio of mixture is small (rich), the inverted output pulse signals or the pulse signals from the NOR gate 126 are delivered from the NOR gate 128 as its output and the pulse signals are applied to an input terminal P of the reversible shift register *7f*.

During this operation, when the control valve 10 is brought into its fully closed position, the switch 11*b* of the fully closed position switch 11 is closed so that the NOR gate 127 of the command circuit *7e* is closed and the pulse motor 8 is prevented from rotating the control valve 10 further in the valve closing direction, thus ensuring normal operation of the control valve 10.

When the pulse signals are applied to the input terminal P of the reversible shift register *7f*, its output terminals $\overline{O}_1$, $\overline{O}_2$, $\overline{O}_3$ and $\overline{O}_4$ are sequentially shifted as shown in FIG. 5A. On the contrary, when the pulse signals are applied to the input terminal O, the output terminals $\overline{O}_4$, $\overline{O}_3$, $\overline{O}_2$ and $\overline{O}_1$ are sequentially shifted as shown in FIG. 5B. These output terminals $\overline{O}_1$, $\overline{O}_2$, $\overline{O}_3$ and $\overline{O}_4$ are connected to the switching circuit *7g* comprising resistors 164, 165, 166 and 167 and back electromotive force absorbing diodes 168, 169, 170 and 171 and the switching circuit *7g* is in turn connected to field coils $C_1$, $C_2$, $C_3$ and $C_4$ of the four-phase motor 8. When the pulse signals are applied to the input terminal P of the reversible shift register *7f*, the transistors 164, 165, 166 and 167 are sequentially turned on and the field coils $C_1$, $C_2$, $C_3$ and $C_4$ are similarly energized two phases at a time, thus rotating the rotor of the pulse motor 8 in the direction of the arrow in FIG. 3 and thereby rotating the control valve 10 in the direction which opens it. On the contrary, when the pulse signals are applied to the terminal 0, the rotor of the pulse motor 8 is rotated in a direction opposite to the direction of the arrow and the control valve 10 is rotated in the direction which closes it.

The control unit 7 and the pulse motor 8 are supplied with power from a battery Ba by way of an ignition key switch KS of the engine 1.

It will thus be seen that during the period of deceleration, irrespective of the signal produced from the air flow meter 14, the pulse motor 8 is intermittently operated at a specified interval of time within a predetermined period T which is determined by the duty ratio of the signal from the second oscillator of the oscillator circuit *7c* and thus the rate of additional air flow is intermittently controlled.

On the other hand, under operating conditions other than the deceleration operation, such as, acceleration and normal operating conditions, (e.g., when the switch 15*b* of the deceleration detecting switch 15 is off), the output of the inverter 118 goes to the "0" level so that the output of the NAND gate 123 goes to the "1" level and simultaneously the output of the NOR gate 125 goes to the "0" level. In other words, irrespective of the signal applied directly from the second oscillator of the oscillator circuit *7c*, the output of the NOR gate 125 goes to the "0" level and it is applied to the NOR gate 126.

On the other hand, under such operating conditions other than the deceleration operation, namely, under the acceleration and normal operating conditions the pulse motor driving pulse signals produced from the first oscillator and inverted as shown in FIGS. 5A and 5B are delivered to the output of the NAND gate 122 and the pulse signals are applied to the NOR gate 124. The NOR gate 124 also receives the pulse signal from the time control circuit *7d* whose width $\tau a$ is varied in accordance with the signal from the air flow meter 14 as shown by the waveform (G) in (a) of FIG. 4, so that only when the pulse signal from the time control circuit *7d* is at the "0" level (i.e., during the time $\tau b$), the pulse motor driving pulse signals produced from the first oscillator are delivered from the NOR gate 124 as its output and the pulse signals are applied to the NOR gate 126.

Consequently, the NOR gate 126 produces as its output the inverted signals of the output signals of the NOR gate 124 or the pulse signals having a waveform as shown by the waveform ($N_2$) in (a) of FIG. 4 and the pulse signals are applied to the NOR gates 127 and 128, respectively.

Similarly as during the deceleration period, the output signals of the NOR gate 126, the signal from the fully closed position switch 11 and the signal from the comparison circuit *7a* are applied to the NOR gates 127 and 128 and the pulse motor 8 is intermittently operated by way of the reversible shift register *7f* and the switching circuit *7g*.

Thus, under the operating conditions other than the deceleration operation, the pulse width $\tau a$ is determined within the predetermined period T by the signal produced from the air flow meter 14 and the pulse motor 8 is intermittently operated with the pulse width $\tau a$ as its running time and the pulse motor 8 is stopped for the duration of each time period $\tau b$. This control is repeatedly performed at the period T and the rate of additional air flow is adjusted in accordance with the amount of intake air which is the system delay time factor.

In other words, depending on whether at the deceleration operation, the NOR gate 126 produces, as its output, pulse signals as shown by the waveform (N) in (b) of FIG. 4 in response to the pulse signals produced from the second oscillator as shown by the waveform (C) in (b) of FIG. 4 and the pulse signals produced from the time control circuit *7d* as shown by the waveform (G) in (b) of FIG. 4 and the pulse motor 8 is thus intermittently operated so as to operate the control valve 10 and thereby always supply the proper amount of additional air.

Generally, there is an inversely proportional relationship between the amount of intake air and the system delay time as shown by the curve of FIG. 6, and this relationship will now be described with reference to FIG. 7 assuming that a delay time $t_1$ corresponds to an intake air amount Y and a delay time $t_2$ corresponds to an intake air amount Z. In the Figure, where the frequency of the pulse motor driving pulses is fixed in the conventional device employing a continuous control system, if, for example, the air-fuel ratio of the mixture supplied to the intake manifold 3 becomes greater than the preset air-fuel ratio (stoichiometric air-fuel ratio) and the mixture becomes lean, during the time $t_1$ the gas sensor 6 cannot detect in the exhaust manifold 4 the fact that the air-fuel ratio has exceeded the preset value and the amount of additional air is increased continuously as shown by the straight line X in FIG. 7. Consequently, the air-fuel ratio of mixture is varied considerably and the control range of air-fuel ratio is increased, thus retarding the adjustment of the air-fuel ratio of mixture to the preset air-fuel ratio. Particularly, in the case of the smaller intake air amount Z, the system delay time is increased to $t_2$ and the amount of additional air is controlled as shown by the straight line X' in the Figure, thus varying the air-fuel ratio of mixture considerably.

On the contrary, with the control device of this invention, under such operating conditions other than the deceleration operation, the pulse motor 8 is operated only for the duration of the time $\tau a$ within the predetermined period T and this operation is effected repeatedly. Consequently, the amount of additional air is intermittently increased as shown by the broken lines Y and Z in FIG. 7 and the additional air is supplied from the additional air passage 9 to the intake manifold 3 through the control valve 10. Thus, the control range of the air-fuel ratio of mixture is maintained small.

Figure 7:
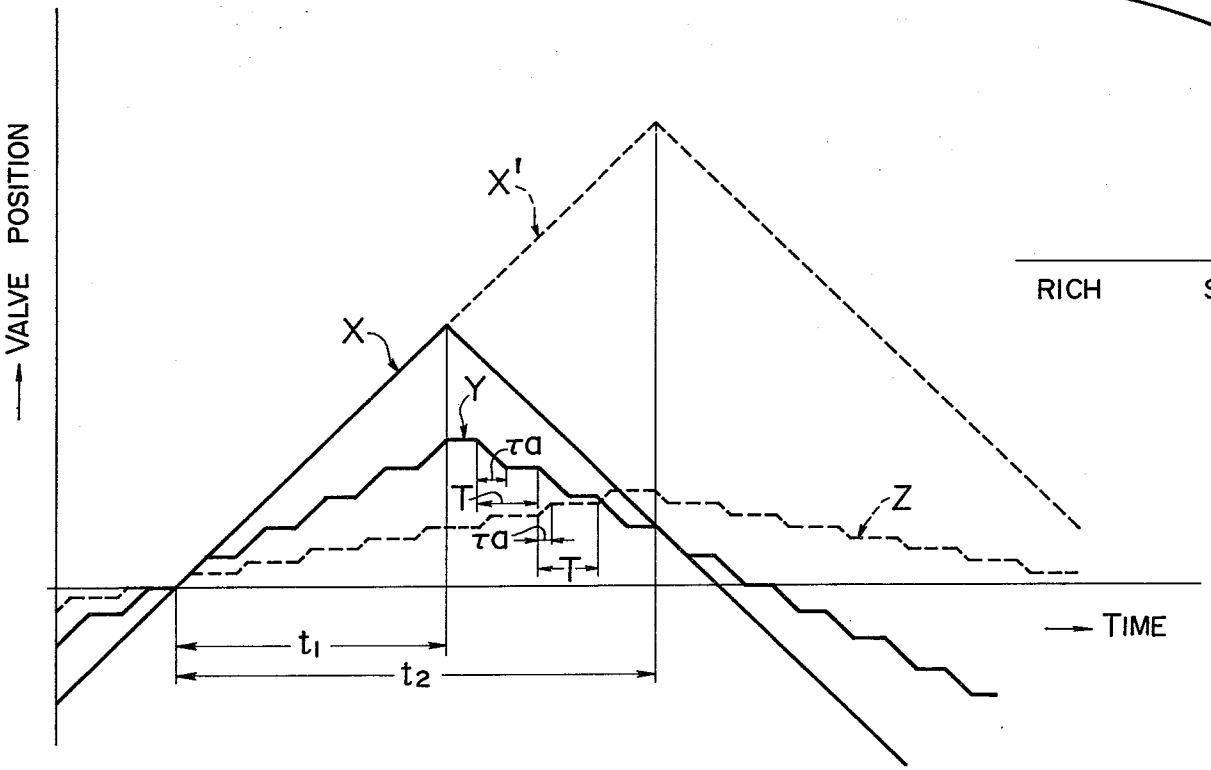
FIG. 7 is a characteristic diagram useful in explaining the operation of the embodiment shown in FIG. 1.

Further, with the control device of this invention, when the amount of intake air is increased as shown at Y in FIG. 6 during the period of acceleration, for example, the running time $\tau a$ of the pulse motor 8 within the period T is increased in proportion to the amount of intake air and since the manner of driving the pulse motor 8 is a skip driving, with the result that the control speed as a whole is increased as shown by the broken line Y in FIG. 7 and the air-fuel ratio of mixture is rapidly adjusted to the preset air-fuel ratio. On the other hand, where the amount of intake air is relatively small as shown at Z in FIG. 6 during the normal operation, for example, the running time $\tau a$ of the pulse motor 8 within the period T is decreased in proportion to the amount of intake air, with the result that the system delay time is increased to $t_2$ and the control speed is correspondingly decreased as shown by the broken line Z in FIG. 7, thus decreasing the control range of air-fuel ratio and thereby rapidly adjusting the air-fuel ratio of mixture to the preset air-fuel ratio.

On the other hand, during the period of deceleration, the pulse motor 8 is operated independently of the signal from the air flow meter 14, that is, by utilizing the inverted signals of the output signals of the second oscillator having a duty ratio which is fixed and large, signals as shown by the waveform ($N_1$) in (a) of FIG. 4 are produced and the pulse motor 8 is operated by these signals, thus increasing the control speed of the control valve 10 and thereby rapidly adjusting the air-fuel ratio of mixture to the preset air-fuel ratio.

By thus accomplishing the control of the air-fuel ratio of mixture through the control of the amount of additional air, any excessive supply of intake air which tends to occur during periods of deceleration is preventing by increasing the control speed of the control valve 10, thus preventing the occurrence of such phenomena as back fire and stalling of the engine 1 due to excessively lean air-fuel mixture and thereby preventing any deterioration of the drivability.

The present invention is not intended to be limited to the above-described embodiment. For example, while the invention has been described as embodied in an additional air control device for adjusting the air-fuel ratio of the mixture produced in a carburetor, the control device can be adapted for compensating the rate of flow of the air in mechanically controlled fuel injection systems.

Further, in addition to the control of the air flow in the intake system of the engine, the control device can be adapted for the control of the air flow in the exhaust system such as the control of the secondary air flow to the catalyst.

Still further, while, in the above described embodiment, a pulse motor is used as driving means, any of DC and AC motors may be used.

Still further, while the time control circuit **7*d*** is of the constant current charging and discharging type, it may be replaced with a circuit of the constant voltage charging and discharging type, for example.

What is claimed is:

1. An additional air control device for an internal combustion engine having an intake system and an exhaust system comprising:

a carburetor connected to the intake system of said internal combustion engine and including a main passage and a bypass passage, for supplying air-fuel mixture to said engine;

said main passage being provided with a throttle valve for controlling an amount of main air-flow and said bypass passage being provided with a control valve for compensating the air-fuel ratio of said air-fuel mixture by controlling an amount of additional air-flow flowing therethrough;

a drive motor coupled to said control valve for driving the same in order to control the opening degree of said control valve;

gas sensing means mounted in the exhaust system of said engine for sensing the oxygen content of the exhaust gases therein and driving an electrical gas sensing signal;

intake air flow sensing means mounted in the intake system of said engine for sensing the rate of intake air flow to said engine and thereby producing an electrical intake air flow signal;

deceleration sensing means coupled to said throttle valve for sensing deceleration of said engine in accordance with the opening degree of said throttle valve and thereby producing an electrical deceleration signal; and electronic control means electrically connected to said gas sensing means, said intake air flow sensing means, said deceleration sensing means and said drive motor, said electronic control means being responsive to said intake air flow signal and said deceleration signal for alternately driving and stopping said drive motor repeatedly in a direction determined in accordance with said gas sensing means;

said electronic control means including a comparison circuit for receiving and comparing said gas sensing signal with a preset value as to relative magnitude and thereby determining the direction of operation of said drive motor, a time control circuit responsive to said intake air flow signal to thereby control a duty ratio $\tau a/\tau b$ between a running time $\tau a$ and a stopping time $\tau b$ of said drive motor, and a command circuit responsive to said deceleration signal to increase said duty ratio independently of said time control circuit during the deceleration period of said engine, whereby the air-fuel ratio of mixture supplied to said engine is maintained substantially constant.

2. An additional air control device for an internal combustion engine having an intake system, an exhaust system, and a catalytic converter for purifying exhaust gases comprising:

a carburetor connected to the intake system of said internal combustion engine and including a passage for supplying substantially rich air-fuel mixture, said passage being provided with a throttle valve for controlling an amount of air-flow;

means defining a bypass passage for supplying additional air to the downstream side of said throttle valve;

a control valve mounted in said bypass passage for controlling the amount of additional air flowing therethrough;

drive means connected to said control valve for driving said control valve to open and close;

gas sensing means mounted in the exhaust system of said engine upstream of said catalytic converter for producing an electrical gas sensing signal corresponding to the composition of exhaust gases flowing through said exhaust system;

delay time factor detecting means for detecting a delay time factor corresponding to a delay time between the occurrence of a change in the air-fuel ratio of mixture at the upstream side of said gas sensing means and the detection by said gas sensing means of said change as a change in the composition of exhaust gases and thereby producing an electrical detection signal;

deceleration sensing means operatively connected to said engine for sensing deceleration of said engine and thereby producing an electrical deceleration signal; and a control unit operatively connected to said gas sensing means, said delay time factor detecting means, said deceleration sensing means and said drive means, said control unit being responsive to said gas sensing signal for alternately driving and stopping said drive means, said control unit being responsive to the detection signal from said deceleration sensing means for increasing the running time of said drive means over the stopping time thereof during the deceleration period of said engine, said control unit being responsive to the detection signal from said delay time factor detecting means to thereby determine the running time and the stopping time of said drive means when said engine is under other operating conditions than the deceleration operation, whereby the composition of exhaust gases flowing into said catalytic converter is properly controlled.

3. An additional air control device for an internal combustion engine having an intake system and an exhaust system comprising:

air-fuel mixture supply means provided in the intake system of said internal combustion engine;

an air pipe disposed to supply additional air to said engine;

a bypass valve mounted in said air pipe for controlling the amount of additional air flowing therethrough;

drive means connected to said bypass valve for driving said bypass valve to open and close;

gas sensing means mounted in the exhaust system of said engine for sensing the oxygen content of the exhaust system of said engine for sensing the oxygen content of the exhaust gases therein and driving an electrical signal;

delay time factor detecting means for detecting a delay time factor corresponding to a delay time between the occurrence of a change in the air-fuel ratio of mixture supplied to said intake system and the detection by said gas sensing means of said change as a change in the composition of exhaust gases supplied to said exhaust system and thereby producing an electrical detection signal;

deceleration sensing means operatively connected to said engine for sensing deceleration of said engine to produce an electrical deceleration signal; and a control unit operatively connected to said drive means, said gas sensing means, said delay time factor detecting means and said deceleration sensing means, said control unit being responsive to the signal from said gas sensing means for operating said drive means in the bypass valve opening direction or the bypass valve closing direction thereof, said control unit causing said drive means to make a skip movement for the duration of a time period $\tau a$ and then stopping said drive means for the duration of a time period $\tau b$, said skip movement and said stopping being repeated alternately at a predetermined period, said control unit receiving the signal from said delay time factor detecting means for controlling a duty ratio $\tau a/\tau b$ between said running time and said stopping time mainly in accordance with the signal from said delay time detecting means, said control unit being responsive to the signal from said deceleration sensing means for increasing said duty ratio $\tau a/\tau b$ independently of said delay time detecting means during the deceleration period of said engine.

4. An additional air control device as claimed in claim 1, wherein a fully closed position switch is further provided to detect that the control valve is in its fully closed position and to provide a signal to said control unit depending on whether or not the control valve is in its fully closed position.

5. An additional air control device as claimed in claim 1, wherein said time control circuit in said electronic control means comprises a monostable circuit connected to receive the intake air flow signal from said intake air flow sensing means and connected to receive a pulse signal for controlling a drive time period of said drive motor generated by a pulse generating circuit in said control means, and wherein operation of said time control circuit is controlled by said intake air flow signal and said driving time period controlling pulse signal and produces a square pulse signals having a pulse width $\tau a$ depending on the amount of intake air flow and at time intervals corresponding to the driving time period controlling pulse signals.

* * * * *